US009242830B2

(12) United States Patent
Yoshimori et al.

(10) Patent No.: US 9,242,830 B2
(45) Date of Patent: Jan. 26, 2016

(54) COIL WINDING METHOD AND TRANSFORMER

(71) Applicant: SHT Corporation Limited, Osaka (JP)

(72) Inventors: Hitoshi Yoshimori, Osaka (JP); Koji Nakashima, Osaka (JP)

(73) Assignee: SHT Corporation Limited, Osaka (JP)

( * ) Notice: Subject to any disclaimer, the term of this patent is extended or adjusted under 35 U.S.C. 154(b) by 0 days.

(21) Appl. No.: 14/548,876

(22) Filed: Nov. 20, 2014

(65) Prior Publication Data

US 2015/0145631 A1 May 28, 2015

Related U.S. Application Data

(63) Continuation of application No. PCT/JP2013/061571, filed on Apr. 19, 2013.

(30) Foreign Application Priority Data

May 31, 2012 (JP) ..... 2012-124012
Jun. 28, 2012 (JP) ..... 2012-144962

(51) Int. Cl.
*H01F 27/24* (2006.01)
*B65H 54/10* (2006.01)
(Continued)

(52) U.S. Cl.
CPC ..... *B65H 54/10* (2013.01); *H01F 5/00* (2013.01); *H01F 27/24* (2013.01); *H01F 27/2847* (2013.01); *H01F 30/10* (2013.01); *H01F 41/0633* (2013.01)

(58) Field of Classification Search
CPC ..... H01F 27/00–27/36
USPC ..... 336/65, 180–184, 196, 220–223
See application file for complete search history.

(56) References Cited

U.S. PATENT DOCUMENTS 3,781,739 A * 12/1973 Meyer ..... H01F 27/343 174/DIG. 24
6,308,401 B1 * 10/2001 Gress ..... H01F 27/2871 29/605

(Continued)

FOREIGN PATENT DOCUMENTS

JP 50-83512 7/1975 ..... H01F 41/06
JP 58-040812 9/1983 ..... H01F 41/06

(Continued)

*Primary Examiner* — Tuyen Nguyen
(74) *Attorney, Agent, or Firm* — J. Peter Paredes; David G. Rosenbaum; Rosenbaum IP P.C.

(57) ABSTRACT

In a manufacturing method of a coil, a plurality of unit coil portions is placed side by side in a winding axis direction, each of the unit coil portions is formed of a plurality of unit wound portions having mutually different inner circumferential lengths, and the unit wound portion having a small inner circumferential length enters inside the unit wound portion having a large inner circumferential length. In coil winding method, a step of forming an outward wound unit coil portion formed of a plurality of unit wound portions laminated from an inner circumferential side to an outer circumferential side and forming an inward wound unit coil portion formed of a plurality of unit wound portions laminated from the outer circumferential side toward the inner circumferential side are alternately repeated. In outward wound unit coil portion, a step of forming the unit wound portion on the outer circumferential side by laminating on an outer circumferential surface of the unit wound portion on the inner circumferential side is repeated. In inward wound unit coil portion, a step of forming the unit wound portion at position spaced apart from the outward wound unit coil portion and pushing in the unit wound portion until it makes contact with a side surface of the outward wound unit coil portion is repeated.

17 Claims, 12 Drawing Sheets

(51) Int. Cl.

| | |
|---|---|
| ***H01F 41/06*** | (2006.01) |
| ***H01F 5/00*** | (2006.01) |
| ***H01F 27/28*** | (2006.01) |
| ***H01F 30/10*** | (2006.01) |

(56) References Cited

U.S. PATENT DOCUMENTS

2011/0090039 A1* 4/2011 Dziubek ..... H01F 27/303
336/223
2011/0109420 A1* 5/2011 Eriksson ..... H01F 27/323
336/207

FOREIGN PATENT DOCUMENTS

| | | | |
|---|---|---|---|
| JP | 05-036555 | 2/1993 | ..... H01F 41/06 |
| JP | 10-116747 | 6/1998 | ..... H01F 4/08 |
| JP | 2003-86438 | 3/2003 | ..... H01F 30/00 |
| JP | 2006-339407 | 12/2006 | ..... H01F 41/06 |
| JP | 2013-021041 | 1/2013 | ..... H01F 41/06 |

* cited by examiner (P1)

(P2)

(P3)

(P4)

(P5)

(P6)

(P7)

(P12)

(P13)

(P14)

⋮

COIL WINDING METHOD AND TRANSFORMER

CROSS-REFERENCE TO RELATED APPLICATIONS

The present application claims priority from and is a continuation application from PCT Application No. PCT/JP2013/061571, filed Apr. 19, 2013; which claims priority from Japanese Patent Application No. 2012-124012, filed May 31, 2012 and Japanese Patent Application No. 2012-144962, filed Jun. 28, 2012, all of which are herein incorporated by reference in their entireties.

TECHNICAL FIELD

The present invention relates to a winding method of a coil formed of a plurality of coil layers and a transformer using such a coil.

BACKGROUND

Conventionally, as illustrated in FIG. 11, a coil is known in which unit coil portions 9 formed by spirally winding a conductive wire 94 are repeatedly placed side by side in a winding axis direction.

As a method of manufacturing such a coil, there is known a method of continuously forming a first unit wound portion 91, a second unit wound portion 92, and a third unit wound portion 93 having mutually different inner circumferential lengths in a winding axis direction by spirally winding a conductive wire as illustrated in FIG. 12A, and continuously forming unit coil portions formed of the pluralities of unit wound portions 91, 92, 93 in the winding axis direction, thereby manufacturing an interim product of an air core coil, and then, compressing the interim product in the winding axis direction, pushing in at least a part of the second unit wound portion 92 inside the third unit wound portion 93, and pushing in at least a part of the first unit wound portion 91 inside the second unit wound portion 92 as illustrated in FIG. 12B, thereby obtaining a finished product of the air core coil formed of a plurality of coil layers (three layers in the example of the figure), (Patent Document 1).

In a transformer for large power and high voltage, as illustrated in FIG. 10, a large coil 8 formed by winding a conductive wire having a coated surface and a rectangular cross-section in multiple layers or a large coil (not shown) formed by lap winding a thin resin film and a wide sheet metal in multiple layers and further increasing the number of turns per row is conventionally used as a primary winding or a secondary winding.

In manufacturing processes of such a coil, as illustrated in FIG. 10, many coil units 81 spirally wound from an inner circumferential side toward an outer circumferential side are manufactured first, and then, the coil units 81 are arrayed in a winding axis direction, and the adjacent coil units 81, 81 are connected in series to each other by a connecting wire (not shown).

SUMMARY OF THE INVENTION

Provided herein are systems, apparatuses and methods for coil winding and a transformer. A coil winding method is disclosed for a manufacturing method of a coil in which unit coil portions formed by spirally winding at least one conductive wire are repeatedly placed side by side in a winding axis direction, each of the unit coil portions is formed of a plurality of unit wound portions having mutually different inner circumferential lengths, and at least a part of the unit wound portion having a small inner circumferential length enters inside the unit wound portion having a large inner circumferential length, the coil winding method comprising: an outward wound unit coil portion forming step of spirally winding the conductive wire from an inner circumferential side toward an outer circumferential side and forming an outward wound unit coil portion formed of the plurality of unit wound portions laminated along a surface orthogonal to a winding axis; and an inward wound unit coil portion forming step of spirally winding the conductive wire from the outer circumferential side toward the inner circumferential side and forming an inward wound unit coil portion formed of the plurality of unit wound portions laminated along the surface orthogonal to the winding axis, wherein by alternately repeating the outward wound unit coil portion forming step and the inward wound unit coil portion forming step, the outward wound unit coil portion and the inward wound unit coil portion are alternately placed along the winding axis, in the outward wound unit coil portion forming step, a step of forming the unit wound portion on an outer circumferential side by laminating on an outer circumferential surface of the unit wound portion on an inner circumferential side is repeated from the inner circumferential side toward the outer circumferential side, and in the inward wound unit coil portion forming step, a step of forming the unit wound portion at a position spaced apart from a forming position of the inward wound unit coil portion and pushing in the unit wound portion along the winding axis direction to the forming position of the inward wound unit coil portion is repeated from the outer circumferential side toward the inner circumferential side.

A transformer is disclosed including a primary winding and a secondary winding, comprising: a coil configuring any one or both of the primary winding and the secondary winding, including: an outward wound unit coil portion formed of a plurality of unit wound portions which is formed by spirally winding a conductive wire from an inner circumferential side toward an outer circumferential side and is laminated along a surface orthogonal to a winding axis; and an inward wound unit coil portion formed of a plurality of unit wound portions which is formed by spirally winding the conductive wire from the outer circumferential side to the inner circumferential side and is laminated along the surface orthogonal to the winding axis, wherein the outward wound unit coil portion and the inward wound unit coil portion are alternately placed along the winding axis, in the outward wound unit coil portion and the inward wound unit coil portion which are adjacent to each other, the unit wound portions in the outermost circumference or the unit wound portions in the innermost circumference are connected with each other, and a connecting wire which connects the unit wound portions in the outermost circumference with each other or the unit wound portions in the innermost circumference with each other is bent into an S shape between the adjacent unit coil portions.

The methods, systems, and apparatuses are set forth in part in the description which follows, and in part will be obvious from the description, or can be learned by practice of the methods, apparatuses, and systems. The advantages of the methods, apparatuses, and systems will be realized and attained by means of the elements and combinations particularly pointed out in the appended claims. It is to be understood that both the foregoing general description and the following detailed description are exemplary and explanatory only and are not restrictive of the methods, apparatuses, and systems, as claimed.

BRIEF DESCRIPTION OF THE DRAWINGS

In the accompanying figures, like elements are identified by like reference numerals among the several preferred embodiments of the present invention.

DETAILED DESCRIPTION OF THE INVENTION

The foregoing and other features and advantages of the invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

Figure 10:
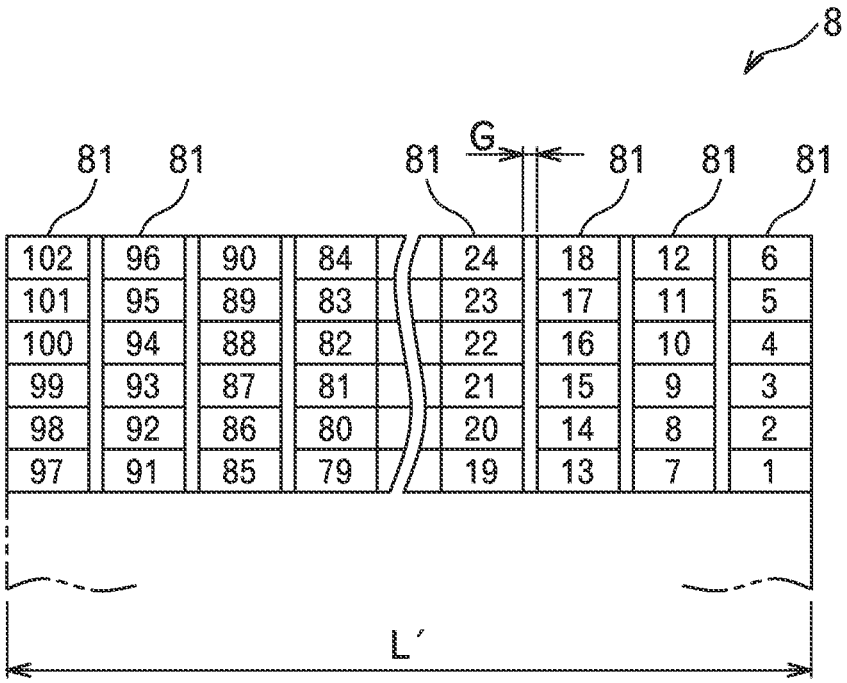
FIG. 10 is a diagram illustrating a winding order of a coil manufactured by a conventional coil winding method.

In the coil 8 illustrated in FIG. 10, since a gap G required for connection using the connecting wire is formed mutually between the many coil units 81, there has been a problem in that an axial length L' of the coil 8 becomes large. The number of turns of each of the coil units 81 may be increased to solve this problem. However, other problem in which an outer diameter of the coil 8 becomes large occurs due to this method.

Figure 11:
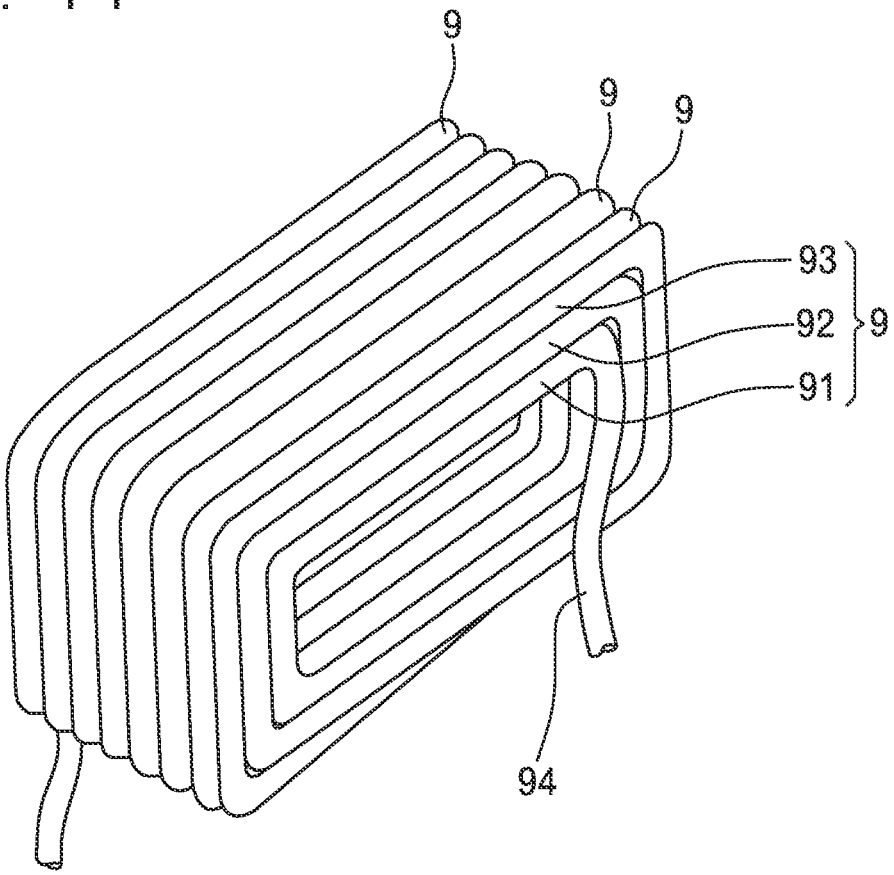
FIG. 11 is a perspective view of the conventional coil.
Figure 12A:
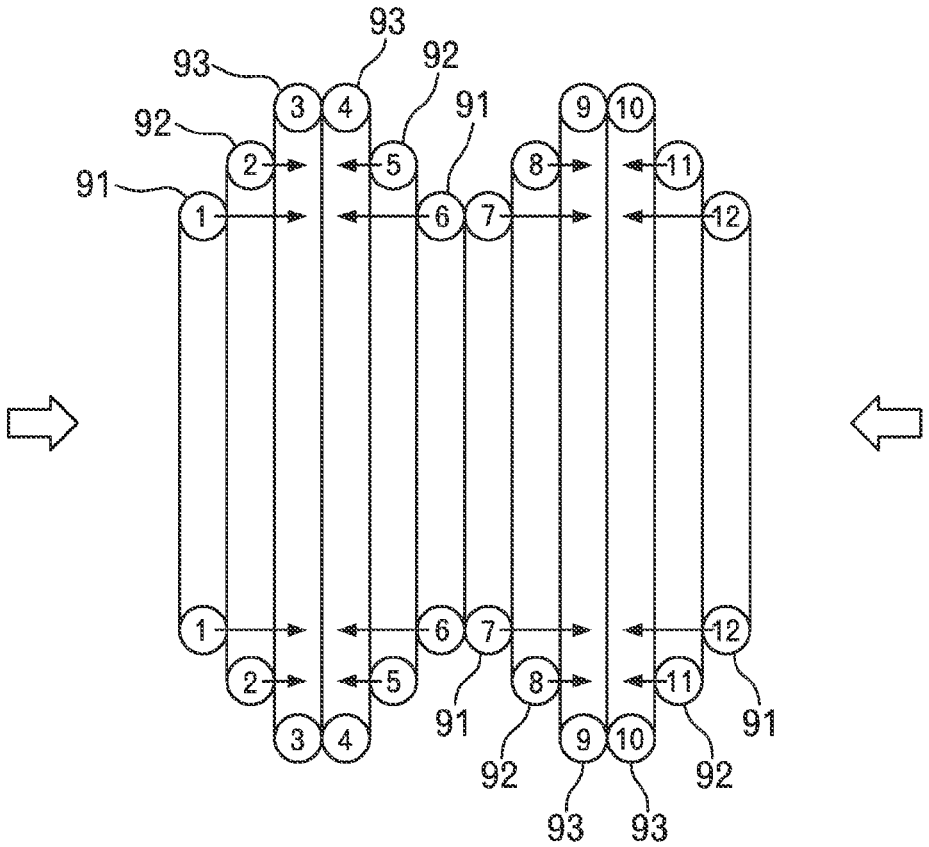
FIGS. 12A-12B are side views of a diagram illustrating manufacturing processes of the coil illustrated in FIG. 11.
Figure 12B:
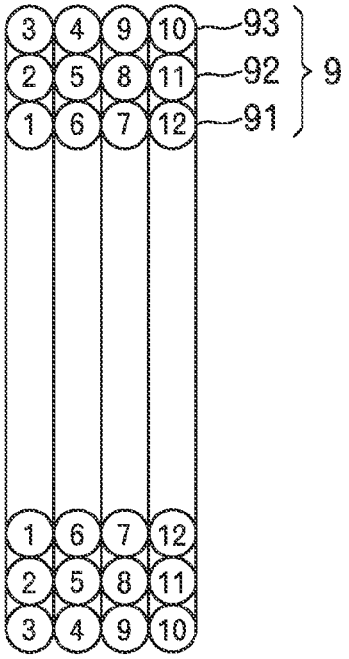

Accordingly, it is considered that a coil having a winding structure similar to that of the coil 9 illustrated in FIGS. 11 and 12 B is manufactured by using the winding method illustrated in FIGS. 12A and 12B.

According to such a coil, since many unit coil portions can be continuously formed, a gap for connection using a connecting wire is not needed, and miniaturization of the coil can be attained.

However, in a case of the particularly large coil 8, since the number of turns exceeds 300 times, it is difficult to orderly array the unit wound portions exceeding 300 in close contact with one another in the winding method in FIGS. 12A and 12B.

In the case where the number of turns of the coil 8 is 300 times or more and the unit coil portion has six layers, since the number of arrays of the unit coil portion exceeds 50, elastic repulsive force becomes large when an interim product is compressed in the winding axis direction as illustrated in FIGS. 12A and 12B. In order to maintain the structure of the unit coil portions which are in contact with one another as in FIG. 12B, it is necessary to have strong fixedly supporting means for maintaining the coil in the compressed state.

An object of the present invention is to provide a manufacturing method of a coil in which unit coil portions formed by spirally winding at least one conductive wire are repeatedly placed in a winding axis direction, each of the unit coil portions is formed of a plurality of unit wound portions having mutually different inner circumferential lengths, and at least a part of the unit wound portion having a small inner circumferential length enters inside the unit wound portion having a large inner circumferential length, and a coil winding method capable of orderly arraying the plurality of unit wound portions and maintaining the plurality of unit coil portions which is in contact with one another by relatively small restraining force.

Further, another object of the present invention is to provide a transformer capable of realizing miniaturization and low loss.

MEANS FOR SOLVING THE PROBLEMS

A coil winding method according to the present invention is a manufacturing method of a coil in which unit coil portions formed by spirally winding at least one conductive wire are repeatedly placed side by side in a winding axis direction, each of the unit coil portions is formed of a plurality of unit wound portions having mutually different inner circumferential lengths, and at least a part of the unit wound portion having a small inner circumferential length enters inside the unit wound portion having a large inner circumferential length, the coil manufacturing method including: an outward wound unit coil portion forming step of spirally winding the conductive wire from an inner circumferential side toward an outer circumferential side and forming an outward wound unit coil portion formed of the plurality of unit wound portions laminated along a surface orthogonal to a winding axis; and an inward wound unit coil portion forming step of spirally winding the conductive wire from the outer circumferential side toward the inner circumferential side and forming an inward wound unit coil portion formed of the plurality of unit wound portions laminated along the surface orthogonal to the winding axis, wherein by alternately repeating the outward wound unit coil portion forming step and the inward wound unit coil portion forming step, the outward wound unit coil portion and the inward wound unit coil portion are alternately placed along the winding axis, in the outward wound unit coil portion forming step, a step of forming the unit wound portion on an outer circumferential side by laminating on an outer circumferential surface of the unit wound portion on an inner circumferential side is repeated from the inner circumferential side toward the outer circumferential side, and in the inward wound unit coil portion forming step, after the unit wound portion in an outermost circumference which is in contact with a side surface of the outward wound unit coil portion formed immediately before is formed, a step of forming the unit wound portion at a position spaced apart from the side surface of the outward wound unit coil portion by at least a width dimension of the conductive wire and pushing in the unit wound portion along the winding axis direction until it makes contact with the side surface of the outward wound unit coil portion is repeated from the outer circumferential side to the inner circumferential side.

It should be noted that in the repetition of the outward wound unit coil portion forming step and the inward wound unit coil portion forming step, there can be employed the method which first starts from the outward wound unit coil portion forming step and ends in the inward wound unit coil portion forming step, the method which first starts from the outward wound unit coil portion forming step and ends in the outward wound unit coil portion forming step, the method which first starts from the inward wound unit coil portion forming step and ends in the inward wound unit coil portion forming step, or the method which first starts from the inward wound unit coil portion forming step and ends in the outward wound unit coil portion forming step.

According to the coil winding method, of the outward wound unit coil portion forming step and the inward wound unit coil portion forming step, in the inward wound unit coil portion forming step, after the unit wound portion is formed at a position spaced apart from the side surface of the previously formed outward wound unit coil portion, the unit wound portion is pushed in along the winding axis direction until it makes contact with the side surface of the outward wound unit coil portion. In this step, elastic repulsive force parallel to the winding axis direction is received from the unit wound portion. However, in the outward wound unit coil portion forming step, since the conductive wire is spirally wound from the inner circumferential side toward the outer circumferential side along the surface orthogonal to the winding axis so as to laminate the unit wound portions, elastic repulsive force parallel to the winding axis direction is not received from the unit wound portions. Therefore, compared with the conventional winding method in which both the outward wound unit coil portion and the inward wound unit coil portion are compressed in the winding axis direction, restraining force needed to maintain the unit coil portions in contact with each other in a state in which the coil is completed becomes smaller.

Further, the plurality of unit wound portions laminated in the outward wound unit coil portion forming step is aligned on the surface vertical to the winding axis without having position variations in the winding axis direction. Accordingly, in the subsequent inward wound unit coil portion forming step, after the unit wound portion is formed at the position spaced apart from the side surface of the previously formed outward wound unit coil portion, the unit wound portion is pushed in along the winding axis direction until it makes contact with the side surface of the outward wound unit coil portion. Consequently, the plurality of unit wound portions configuring the inward wound unit coil portion is also aligned on the surface vertical to the winding axis without having position variations in the winding axis direction. As a result, the pluralities of unit wound portions configuring the coil are orderly arrayed.

In a specific aspect, in the outward wound unit coil portion forming step, by rotating a winding base member around the winding axis, plural layers of the unit wound portions are formed around the winding base member.

With this configuration, the plurality of unit wound portions is sequentially laminated from the inner circumferential side toward the outer circumferential side along the surface orthogonal to the winding axis.

Further, in a specific aspect, in the inward wound unit coil portion forming step, the plurality of unit wound portions is formed by rotating a conductive wire winding control mechanism around the winding axis, the conductive wire winding control mechanism includes a plurality of winding members laminated in a direction orthogonal to the winding axis and a reciprocally driving device causing each of the winding members to reciprocate along the winding axis, and due to operation of the reciprocally driving device, by rotating the conductive wire winding control mechanism in a state in which an outer circumferential surface of one winding member of the plurality of winding members is exposed, the conductive wire is wound around the outer circumferential surface of the one winding member, and the unit wound portion having an inner circumferential length according to an outer shape of the one winding member is formed.

With this configuration, each of the plurality of unit wound portions configuring the inward wound unit coil portion is formed to have an accurate shape and inner circumferential length.

Further, in the inward wound unit coil portion forming step, after the one unit wound portion is formed by winding the conductive wire around the outer circumferential surface of the one winding member, by advancing the winding member disposed on an outer circumferential side of the one winding member in the winding axis direction, the unit wound portion is pushed in until it makes contact with the side surface of the outward wound unit coil portion.

With this configuration, the unit wound portion on the inner circumferential side is formed in contact with the inner circumferential surface of the unit wound portion on the outer circumferential side, and the plurality of unit wound portions is aligned on the surface orthogonal to the winding axis.

Further, in a specific aspect, after the unit wound portion is pushed in due to the advance of the winding member, the winding member disposed on an inner circumferential side of the winding member is caused to retreat together with one or the plurality of winding members disposed further on the outer circumferential side than the winding member on the inner circumferential side, so that an outer circumferential surface of the winding member on the inner circumferential side, around which the conductive wire is to be wound next, is exposed.

Further, in a specific aspect, the conductive wire winding control mechanism is provided with a support member which supports, even after the retreat of the winding member, the unit wound portion pushed in until it makes contact with the side surface of the outward wound unit coil portion.

According to the specific aspect, since the unit wound portion wound around the one winding member is supported by the support member even after the retreat of the winding member, a winding shape is not collapsed.

Further, in a specific aspect, after the outward wound unit coil portion or the inward wound unit coil portion is formed, by advancing all the winding members of the conductive wire winding control mechanism, all the previously formed unit coil portions are moved in the winding axis direction by the width dimension of the conductive wire.

With this configuration, the plurality of unit coil portions is fed in the winding axis direction while being formed continuously.

Further, in a specific aspect, in the step of pushing in the unit wound portion due to the advance of the winding member, by abutting a guide plate on the side surface of the first formed outward wound unit coil portion on a side opposite to the winding member, pressing force due to the advance of the winding member is received.

According to the specific aspect, since the pressing force generated in the forming step of the inward wound unit coil portion is received by the guide plate, the plurality of unit wound portions configuring the inward wound unit coil portion is reliably pushed against the outward wound unit coil portion and can make contact with the side surface of the wound unit coil portion.

Further, in a specific aspect, when the inward wound unit coil portion is formed after the formation of the outward wound unit coil portion, a connecting wire provided from the unit wound portion in the outermost circumference of the outward wound unit coil portion to the unit wound portion in the outermost circumference of the inward wound unit coil portion is formed at the conductive wire, and when the outward wound unit coil portion is formed after the formation of the inward wound unit coil portion, a connecting wire provided from the unit wound portion in an innermost circumference of the inward wound unit coil portion to the unit wound portion in an innermost circumference of the outward wound unit coil portion is formed at the conductive wire.

In a more specific aspect, the connecting wire is formed by bending the conductive wire into an S shape between the adjacent unit coil portions.

In a transformer according to the present invention, a coil configuring any one or both of a primary winding and a secondary winding, includes: an outward wound unit coil portion formed of a plurality of unit wound portions which is formed by spirally winding a conductive wire from an inner circumferential side toward an outer circumferential side and is laminated along a surface orthogonal to a winding axis, and an inward wound unit coil portion formed of a plurality of unit wound portions which is formed by spirally winding the conductive wire from the outer circumferential side to the inner circumferential side and is laminated along the surface orthogonal to the winding axis, wherein the outward wound unit coil portion and the inward wound unit coil portion are alternately placed along the winding axis, and in the outward wound unit coil portion and the inward wound unit coil portion which are adjacent to each other, the unit wound portions in the outermost circumference or the unit wound portions in the innermost circumference are connected with each other.

In a specific aspect of the transformer, the outward wound unit coil portion is manufactured by repeating, from the inner circumferential side to the outer circumferential side, a step of forming the unit wound portion on the outer circumferential side by laminating on an outer circumferential surface of the unit wound portion on the inner circumferential side, and the inward wound unit coil portion is manufactured by repeating, from the outer circumferential side toward the inner circumferential side, a step of forming the unit wound portion at a position spaced apart from a side surface of the outward wound unit coil portion formed immediately before and pushing in the unit wound portion along the winding axis direction until it makes contact with the side surface of the outward wound unit coil portion.

EFFECTS OF THE INVENTION

According to the coil winding method of the present invention, the pluralities of unit wound portions are orderly arrayed, and the pluralities of unit coil portions can be maintained in contact with one another by relatively small restraining force.

Further, according to the transformer of the present invention, since the pluralities of unit coil portions configuring the coil are arrayed in close contact with one another, miniaturization of the coil and also miniaturization of the transformer can be realized. Moreover, since iron loss can be reduced by miniaturization of the core accompanying the miniaturization of the coil, low loss of the transformer can be realized.

Further, according to the transformer of the present invention, since the gap between the plurality of coil layers is eliminated, a wider conductor (thick wire) can be wound by utilizing this space. With this configuration, electric resistance of the coil is lowered and copper loss can be reduced.

Further, according to the transformer of the present invention, since the plurality of unit coil portions is continuously wound without being divided, a material for connecting the unit coil portions with each other and a connection process therefor can be omitted.

An embodiment of the present invention will be specifically described with reference to the drawings.

Figure 8:
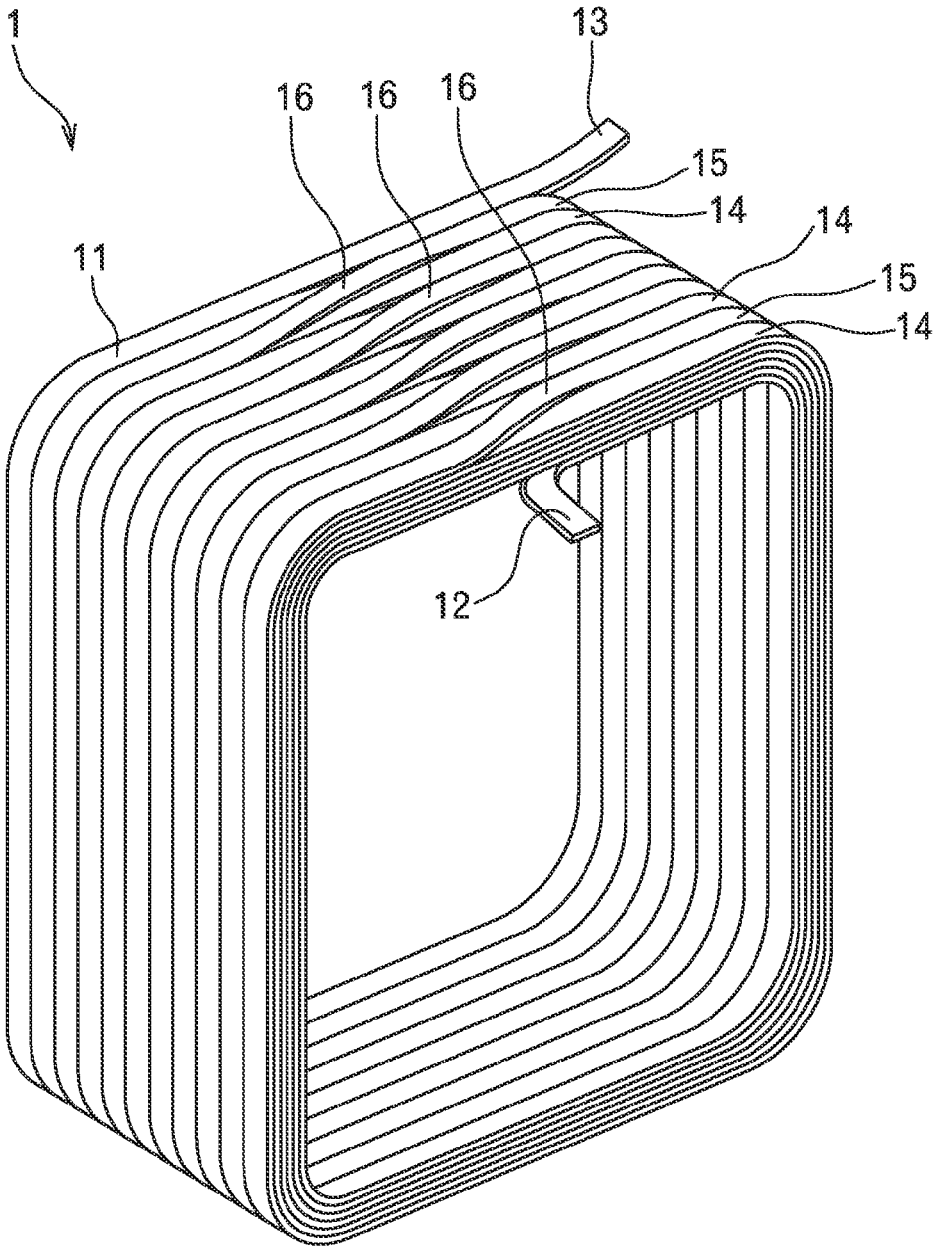
FIG. 8 is a perspective view of a coil manufactured by the coil winding method according to the present invention.

FIG. 8 illustrates a coil 1 to be manufactured according to a winding method of the present invention. The coil 1 is formed by spirally winding a flat conductive wire 11 having an insulation coated surface and a rectangular cross-section and has a substantially square cylindrical shape as a whole. A winding start portion 12 and a winding end portion 13 are drawn out from both ends of the coil 1. Further, the conductive wire 11 is bent into an arc shape at four corners of the coil 1. An outer circumferential surface of an inner arc line portion and an inner circumferential surface of an outer arc line portion which are laminated in a radial direction have the same radius of curvature and are in contact with each other.

Figure 9:
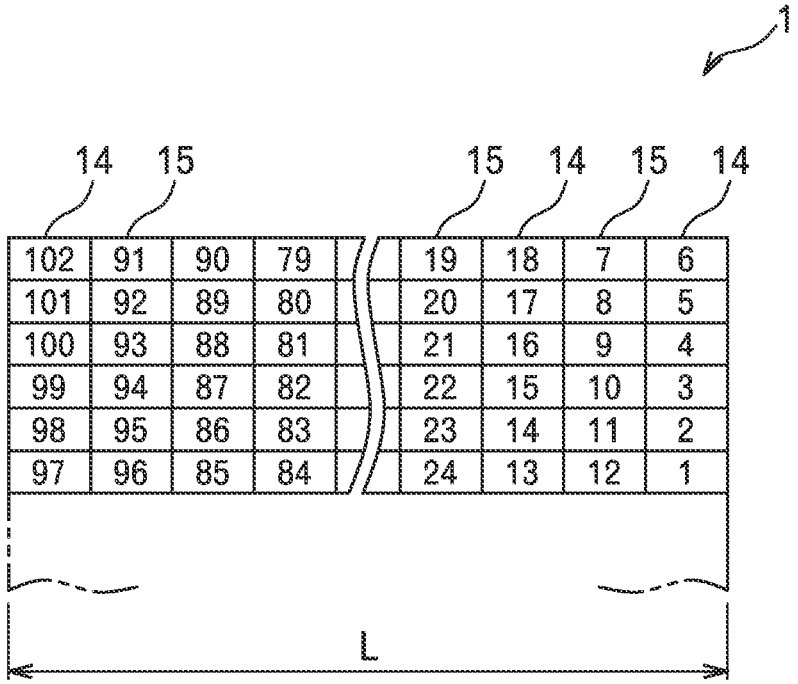
FIG. 9 is a diagram illustrating a winding order of the coil manufactured by the coil winding method of the present invention.

FIG. 9 illustrates a winding order of the coil 1. In the coil 1, an outward wound unit coil portion 14, which is formed by laminating a plurality of unit wound portions from an inner circumferential side toward an outer circumferential side along a surface orthogonal to an winding axis, and an inward wound unit coil portion 15, which is formed by laminating a plurality of unit wound portions from the outer circumferential side toward the inner circumferential side along the surface orthogonal to the winding axis, are repeatedly arrayed alternately along a winding axis direction.

The adjacent outward wound unit coil portion 14 and inward wound unit coil portion 15 are in contact with each other, and the pluralities of unit wound portions respectively configuring the outward wound unit coil portion 14 and the inward wound unit coil portion 15 are in contact with each other in a laminating direction. Further, in the outward wound unit coil portion 14 and the inward wound unit coil portion 15 which are in contact with each other, the unit wound portions in an innermost circumference or the unit wound portions in an outermost circumference are connected with each other via a connecting wire (not shown).

As illustrated in FIG. 8, a connecting wire 16 which connects the unit wound portions in the outermost circumference with each other is formed by bending the conductive wire into an S shape between the adjacent unit coil portions. A connecting wire which connects the unit wound portions in the innermost circumference with each other is also formed in the same manner.

Therefore, compared with a case where the gap G is formed between the coil units 81, 81 adjacent to each other and the length L' in the winding axis direction becomes large like the conventional coil 8 illustrated in FIG. 10, according to the coil 1 illustrated in FIG. 9, a length L in the winding axis direction can be made small.

Figure 1:
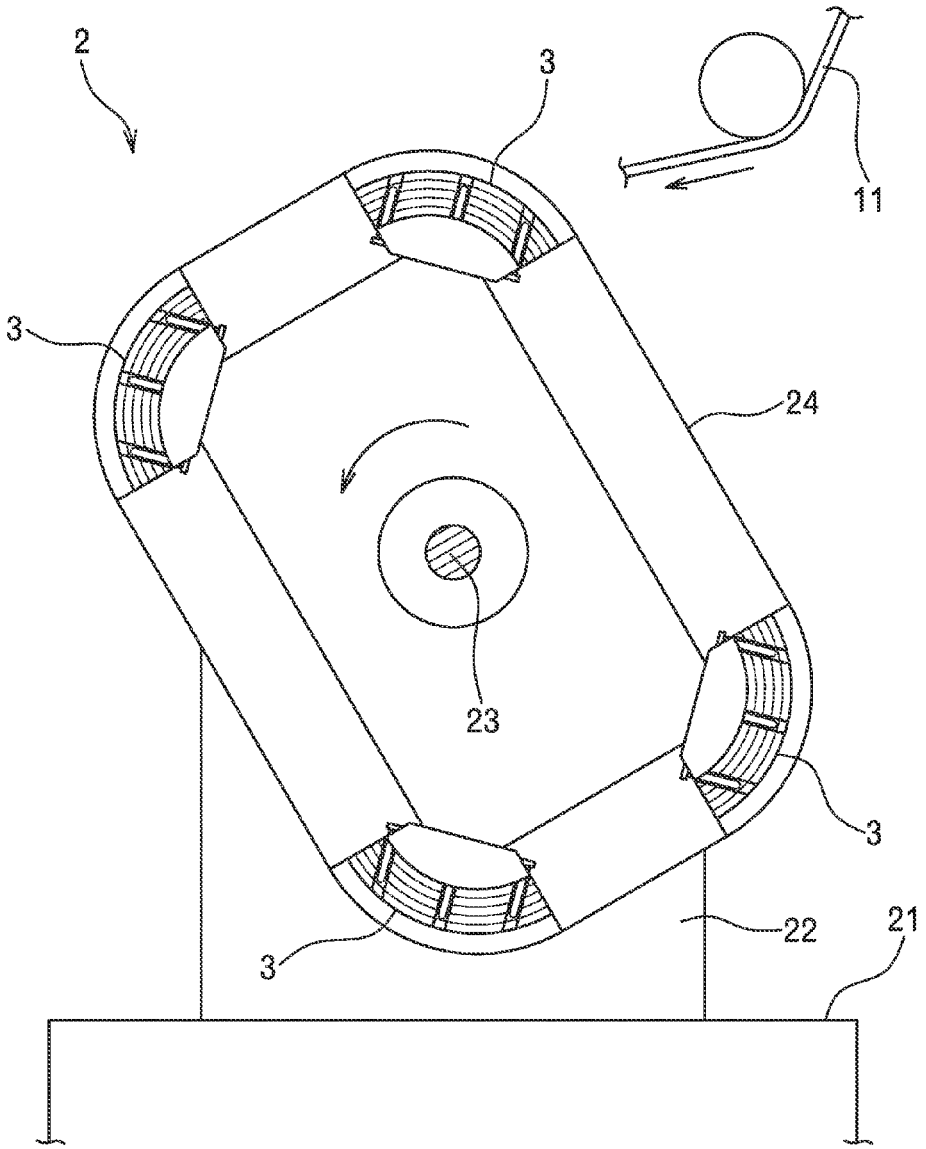
FIG. 1 is a partly breakaway front view of a winding machine for implementing a coil winding method.

FIG. 1 illustrates a winding machine 2 for manufacturing the coil 1 in which the outward wound unit coil portion 14 and the inward wound unit coil portion 15 are respectively formed of six layers of the unit wound portions. In the winding machine 2, a conductive wire take-up device 24 is supported by a frame 22 on a machine stand 21 so as to be freely rotatable around a horizontal rotation axis 23 and can be rotationally driven by a motor (not shown).

The conductive wire take-up device 24 includes a conductive wire winding portion 3 at each of substantially rectangular four corners with the rotation axis 23 as a center. By simultaneously rotating the four conductive wire winding portions 3 to 3, the conductive wire 11 is wound around the conductive wire winding portions 3 to 3, and the coil 1 illustrated in FIG. 8 is manufactured.

Figure 2:
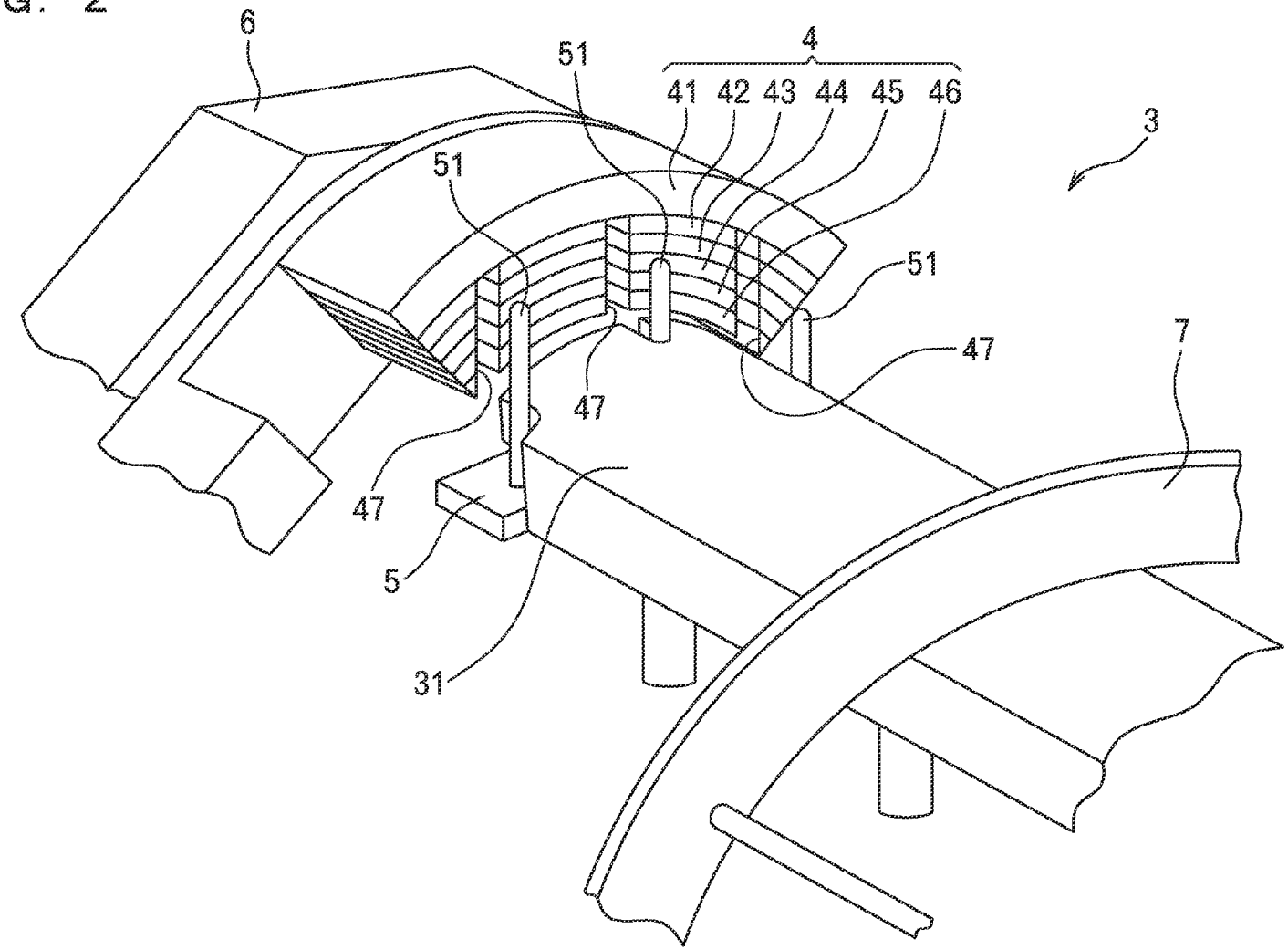
FIG. 2 is a perspective view illustrating a main part of the winding machine.

As illustrated in FIG. 2, the conductive wire winding portion 3 includes a winding base member 31 whose outer circumferential surface is an arc surface, a conductive wire winding control mechanism 4, and a reciprocally driving device 6 connected to the conductive wire winding control mechanism 4. The conductive wire winding control mechanism 4 is configured by laminating a first winding member 41, a second winding member 42, a third winding member 43, a fourth winding member 44, a fifth winding member 45, and a sixth winding member 46, which are respectively arcuate pieces over an angular range of 90 degrees, in a direction orthogonal to the rotation axis 23. Each of the winding portions 41 to 46 has an outer circumferential surface which is an arc surface parallel to the rotation axis 23 and side surfaces orthogonal to the rotation axis 23.

Further, each of the second winding member 42, the third winding member 43, the fourth winding member 44, the fifth winding member 45, and the sixth winding member 46 is reciprocally driven independently in a direction along the rotation axis 23 by the reciprocally driving device 6.

The outer circumferential surfaces of the second winding member 42, the third winding member 43, the fourth winding member 44, the fifth winding member 45, the sixth winding member 46, and the winding base member 31 respectively have the same radii of curvature as those of the inner circumferential surfaces of the six unit wound portions laminated in each of the four corners of the coil 1 illustrated in FIG. 8. Further, thicknesses of the second winding member 42, the third winding member 43, the fourth winding member 44, the fifth winding member 45, and the sixth winding member 46 are substantially coincident with the thickness of the conductive wire forming the coil 1.

The conductive wire winding portion 3 includes a rising and lowering plate 5, which rises and lowers in the direction orthogonal to the rotation axis 23, and three support pins 51, 51, 51 provided upright on the rising and lowering plate 5. Three grooves 47, 47, 47 where the three support pins 51, 51, 51 can be inserted are opened at the second winding member 42, the third winding member 43, the fourth winding member 44, the fifth winding member 45, and the sixth winding member 46.

A guide plate 7 orthogonal to the rotation axis 23 is disposed at the conductive wire take-up device 24 so as to be reciprocally movable in a direction along the rotation axis 23.

FIGS. 3 to 7 each illustrate the winding method of the coil 1 using the winding machine 2. First, in a first process P1 in FIG. 3A, one side surface 4*a* orthogonal to the rotation axis 23 is formed by the first winding member 41, the second winding member 42, the third winding member 43, the fourth winding member 44, the fifth winding member 45, and the sixth winding member 46, which configure the conductive wire winding control mechanism 4. Then, the conductive wire is wound around the four winding base members 31 by rotating the conductive wire take-up device 24 once, thereby forming a first layer unit wound portion.

It should be noted that when the first layer unit wound portion is formed, a tip part of the conductive wire 11 illustrated in FIG. 1 is locked on the conductive wire take-up device 24. By rotating the conductive wire take-up device 24 in this state, a certain degree of tension acts on the conductive wire 11.

Figure 3A:
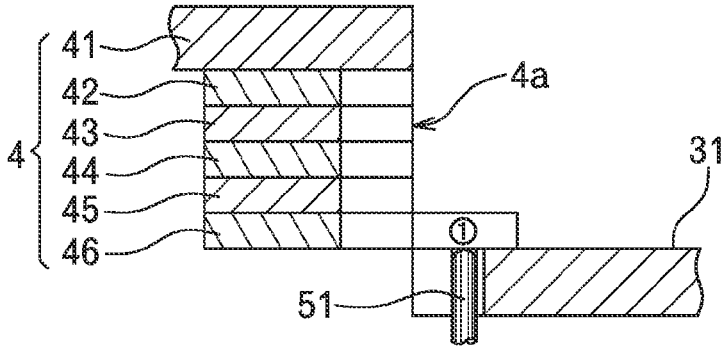
FIGS. 3A-3B are cross-sectional views of a diagram illustrating a first process to a third process of the coil winding method.
Figure 3A:
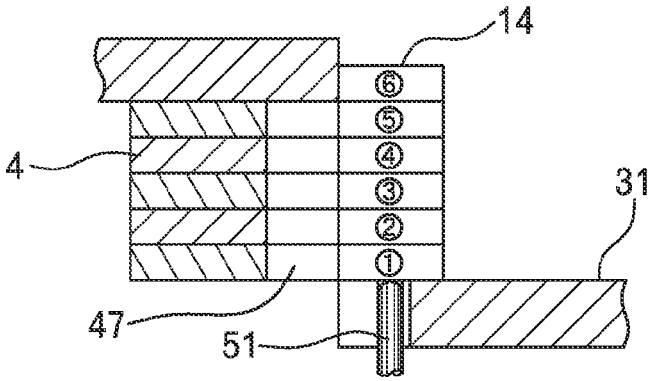

Next, in a second process P2 in FIG. 3A, by further rotating the conductive wire take-up device 24 five times, a second layer unit wound portion, a third layer unit wound portion, a fourth layer unit wound portion, a fifth layer unit wound portion, and a sixth layer unit wound portion are laminated on the first layer unit wound portion, thereby forming the outward wound unit coil portion 14. Since the outward wound unit coil portion 14 is formed along the side surface 4*a* of the conductive wire winding control mechanism 4, six layers of the unit wound portions are vertically laminated without having variations in the winding axis direction.

It should be noted that in the first process P1 and the second process P2, the outward wound unit coil portion 14 can be formed more precisely by the guide plate 7 illustrated in FIG. 2 by guiding formation of the outward wound unit coil portion 14 from a side opposite to the side surface 4*a* of the conductive wire winding control mechanism 4.

Figure 3B:
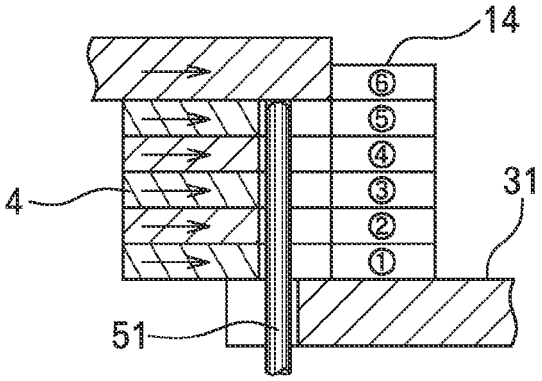

In a third process P3 in FIG. 3B, the conductive wire winding control mechanism 4 is advanced to the winding base member 31 side along the rotation axis 23, and the outward wound unit coil portion 14 is moved by one pitch corresponding to a width of a winding. In this process, the support pins 51 are accommodated within the grooves 47 of the conductive wire winding control mechanism 4.

Figure 4A:
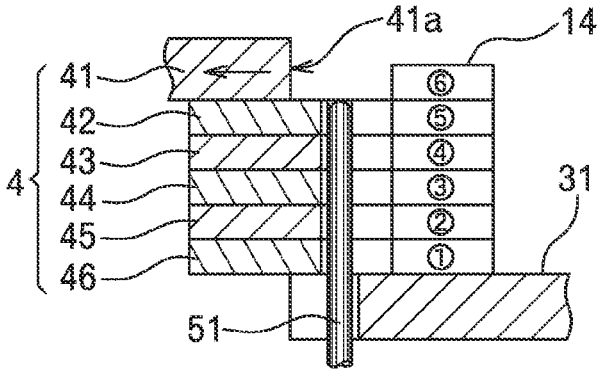
FIGS. 4A-4D are cross-sectional views of a diagram illustrating a fourth process to a seventh process of the coil winding method.
Figure 4B:
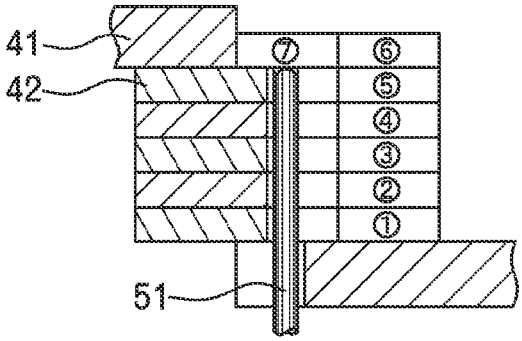

In a fourth process P4 illustrated in FIG. 4A, the first winding member 41 is retreated by a distance corresponding to a width of the conductive wire, thereby exposing an outer circumferential surface of the second winding member 42. In a fifth process P5, as shown in FIG. 4B, the conductive wire is wound around the outer circumferential surfaces of the four second winding members 42 by rotating the conductive wire take-up device 24 once, thereby forming a seventh layer unit wound portion. The seventh layer unit wound portion is formed along a side surface 41*a* of the first winding member 41 and in contact with the sixth layer unit wound portion.

It should be noted that in a transition from the fourth process P4 to the fifth process P5, the connecting wire 16 illustrated in FIG. 8 is formed between the sixth layer unit coil portion and the seventh layer unit coil portion.

Figure 4C:
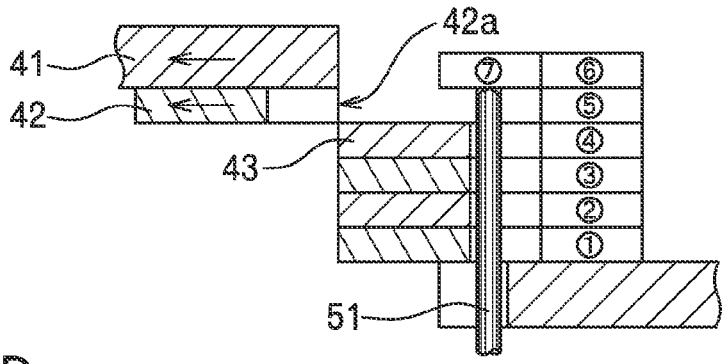

In a sixth process P6, as shown in FIG. 4C, the first winding member 41 is retreated by the distance corresponding to the width of the conductive wire, and the second winding member 42 is retreated by a distance corresponding to twice the width of the conductive wire, thereby exposing an outer circumferential surface of the third winding member 43. Even when the second winding member 42 is retreated, since the seventh layer unit coil portion is supported by the support pin 51, a winding shape is not collapsed.

Figure 4D:
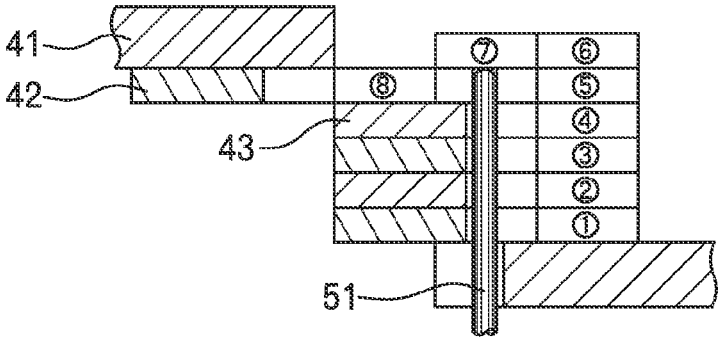

In a seventh process P7, as shown in FIG. 4D, the conductive wire is wound around the outer circumferential surfaces of the four third winding members 43 by rotating the conductive wire take-up device 24 once, thereby forming an eighth layer unit wound portion. Here, the eighth layer unit wound portion is formed along a side surface 42*a* of the second winding member 42.

Figure 5A:
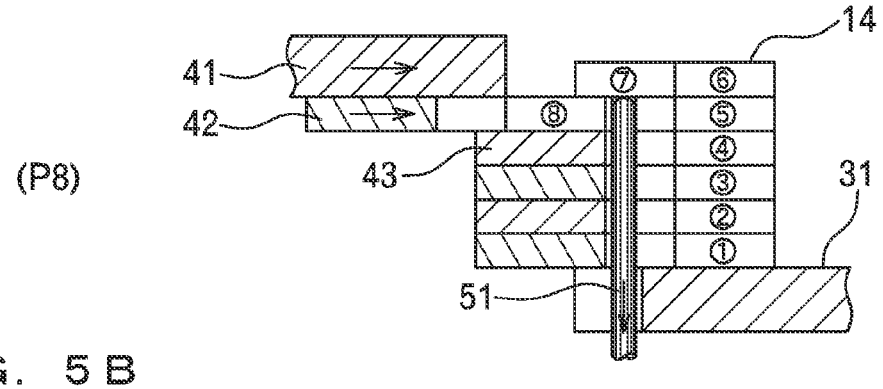
FIGS. 5A-5D are cross-sectional views of a diagram illustrating an eighth process to an eleventh process of the coil winding method.
Figure 5B:
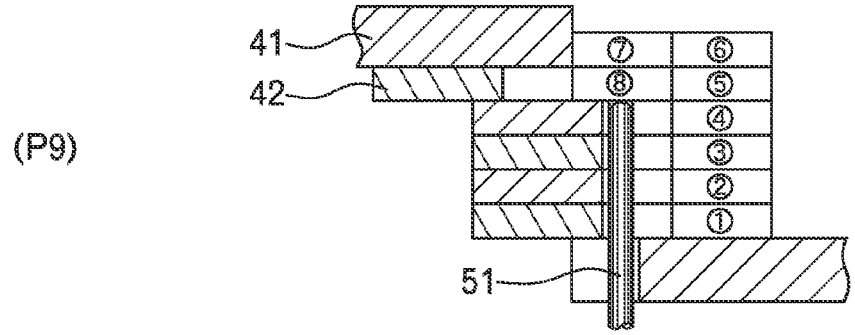

In an eighth process P8 in FIG. 5A, the first winding member 41 and the second winding member 42 are advanced by the distance corresponding to the width of the conductive wire, and the eighth layer unit wound portion is pushed in inside the seventh layer unit wound portion. At the same time, the support pin 51 is lowered by a thickness of the winding. With this configuration, as illustrated in a ninth process P9 and FIG. 5B, the eighth layer unit wound portion is in contact with a side surface of the fifth layer unit wound portion and is in contact with an inner circumferential surface of the seventh layer unit wound portion.

It should be noted that in the eighth process P8, in the process of pushing in the eighth layer unit wound portion, it is effective that the outward wound unit coil portion 14 is received by the guide plate 7. With this configuration, the eighth layer unit wound portion can be more reliably pushed against the fifth layer unit wound portion.

Figure 5C:
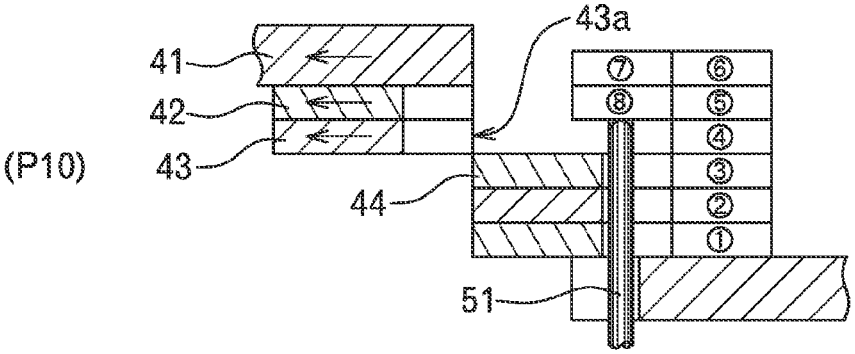

In a tenth process P10 in FIG. 5C, the first winding member 41 and the second winding member 42 are retreated by the distance corresponding to the width of the conductive wire, and the third winding member 43 is retreated by the distance corresponding to twice the width of the conductive wire, thereby exposing an outer circumferential surface of the fourth winding member 44. Even when the third winding member 43 is retreated, since the eighth layer unit coil portion is supported by the support pin 51, the winding shape is not collapsed.

Figure 5D:
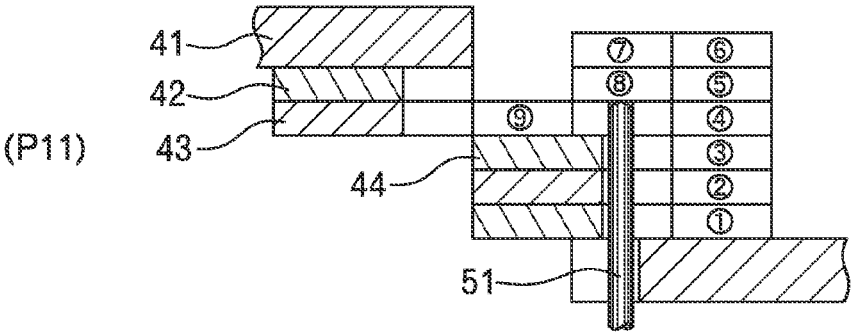

In an eleventh process P11 in FIG. 5D, the conductive wire is wound around the outer circumferential surfaces of the four fourth winding members 44 by rotating the conductive wire take-up device 24 once, thereby forming a ninth layer unit wound portion. Here, the ninth layer unit wound portion is formed along a side surface 43*a* of the third winding member 43.

Figure 6A:
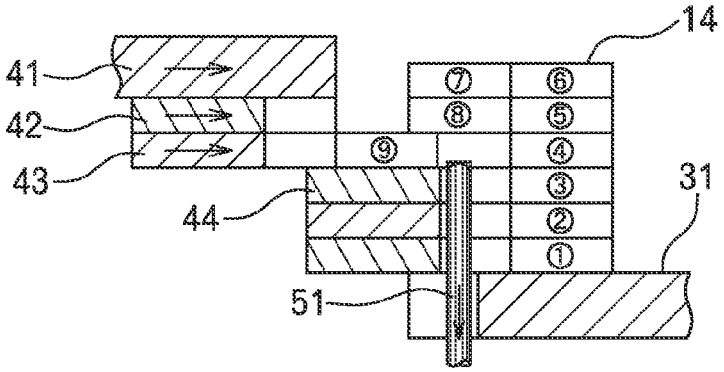
FIGS. 6A-6B is a diagram illustrating a twelfth process to a fourteenth process of the coil winding method.

In a twelfth process P12 illustrated in FIG. 6A, the first winding member 41, the second winding member 42, and the third winding member 43 are advanced by the distance corresponding to the width of the conductive wire, and the ninth layer unit wound portion is pushed in inside the eighth layer unit wound portion. Simultaneously, the support pin 51 is lowered by the thickness of the winding. With this configuration, as illustrated in a thirteenth process P13 in FIG. 6B, the ninth layer unit wound portion is in contact with a side surface of the fourth layer unit wound portion and is in contact with an inner circumferential surface of the eighth layer unit wound portion.

It should be noted that in the twelfth process P12, in the process of pushing the ninth layer unit wound portion, it is effective that the outward wound unit coil portion 14 is received by the guide plate 7. With this configuration, the ninth layer unit wound portion can be more reliably pushed against the fourth layer unit wound portion.

Figure 6B:
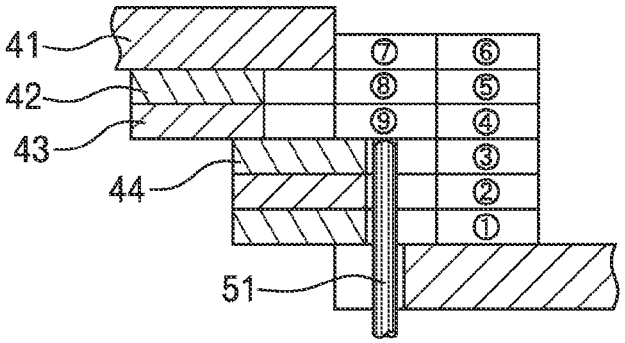
Figure 6B:
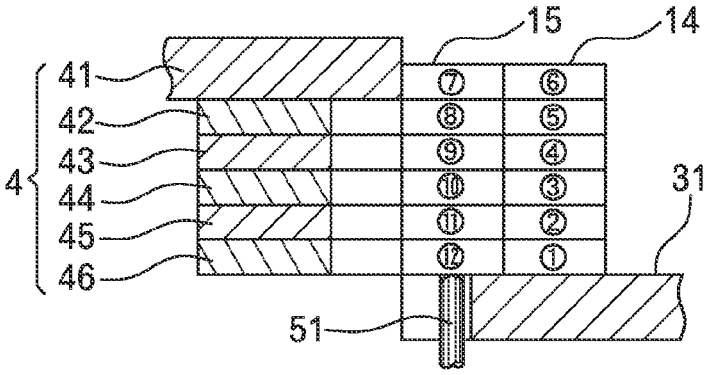

After that, as illustrated in a fourteenth process P14 in FIG. 6B, a tenth layer unit wound portion to a twelfth layer unit wound portion are formed by repeating processes similar to the tenth process P10 to the thirteenth process P13. As a result, the inward wound unit coil portion 15 is formed.

Since the inward wound unit coil portion 15 is formed in contact with a side surface of the previously formed outward wound unit coil portion 14, six layers of the unit wound portions are vertically laminated without having variations in the winding axis direction.

Figure 7A:
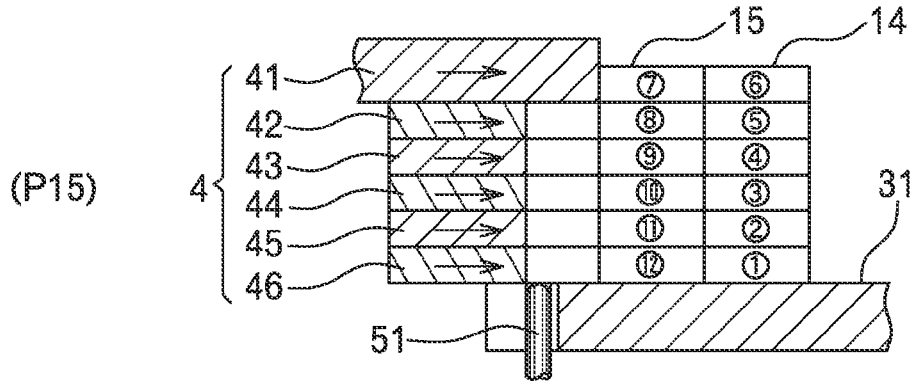
FIGS. 7A-7C are cross-sectional views of a diagram illustrating a fifteenth process, a sixteenth process, and a next first process of the coil winding method according to the present invention.

In a fifteenth process P15 illustrated in FIG. 7A, the conductive wire winding control mechanism 4 is advanced to the winding base member 31 side along the rotation axis 23, and the outward wound unit coil portion 14 and the inward wound unit coil portion 15 are moved by one pitch corresponding to the width of the conductive wire.

Figure 7B:
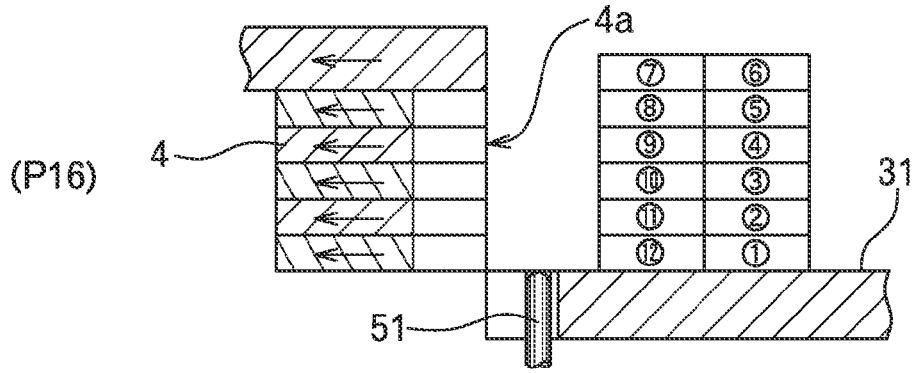
Figure 7C:
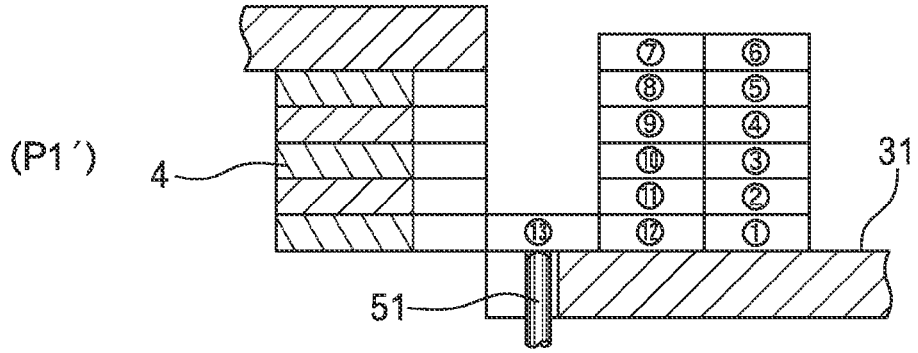

In a sixteenth process P16 in FIG. 7B, the conductive wire winding control mechanism 4 is retreated by the distance corresponding to the width of the conductive wire. With this configuration, the next outward wound unit coil portion 14 can be formed along the side surface 4*a* of the conductive wire winding control mechanism 4. In other words, in a subsequent first process P1' in FIG. 7C, the conductive wire is wound around the four winding base members 31 by rotating the conductive wire take-up device 24 once, thereby forming a thirteenth layer unit wound portion. It should be noted that in a transition from the sixteenth process P16 to the subsequent first process P1', a connecting wire is formed between the twelfth layer unit coil portion and the thirteenth layer unit coil portion.

After that, the coil 1 in which the direction wound unit coil portion 14 and the inward wound unit coil portion 15 are repeatedly formed alternately as illustrated in FIG. 8, is completed by repeating the similar processes.

According to the coil winding method, in the forming process of the inward wound unit coil portion 15, for example, as illustrated in the eighth process P8 in FIG. 5A or the twelfth process P12 in FIG. 6A, in the process of pushing in the unit wound portion configuring the inward wound unit coil portion 15 along the winding axis direction until it makes contact with the side surface of the previously formed outward wound unit coil portion 14, elastic repulsive force parallel to the winding axis direction is received from the unit wound portion. However, in the forming process of the outward wound unit coil portion 14, for example, as illustrated in the first process P1 to the second process P2 in FIG. 3A, since the conductive wire is spirally wound from the inner circumferential side to the outer circumferential side along the surface orthogonal to the winding axis so as to laminate the unit wound portion, the elastic repulsive force parallel to the winding axis direction is not received from the unit wound portion.

Therefore, compared with the conventional winding method in which both the outward wound unit coil portion and the inward wound unit coil portion are compressed in the winding axis direction, restraining force needed to maintain the unit coil portions in contact with each other in a state in which the coil is completed is reduced by half. Accordingly, in the coil 1 illustrated in FIG. 1, all the unit wound portions can be maintained in contact with one another by binding a bundle of unit wound portions by simple means, such as an insulating tape.

Further, the plurality of unit wound portions laminated in the forming process of the outward wound unit coil portion 14 is aligned on the surface vertical to the winding axis without having position variations in the winding axis direction. Accordingly, in the forming process of the inward wound unit coil portion 15 after that, by pushing the unit wound portions along the winding axis direction until they make contact with the side surface of the outward wound unit coil portion 14, the plurality of unit wound portions configuring the inward wound unit coil portion 14 is also aligned on the surface vertical to the winding axis without having position variations in the winding axis direction. As a result, the pluralities of unit wound portions configuring the coil 1 are orderly arrayed.

Figure 13:
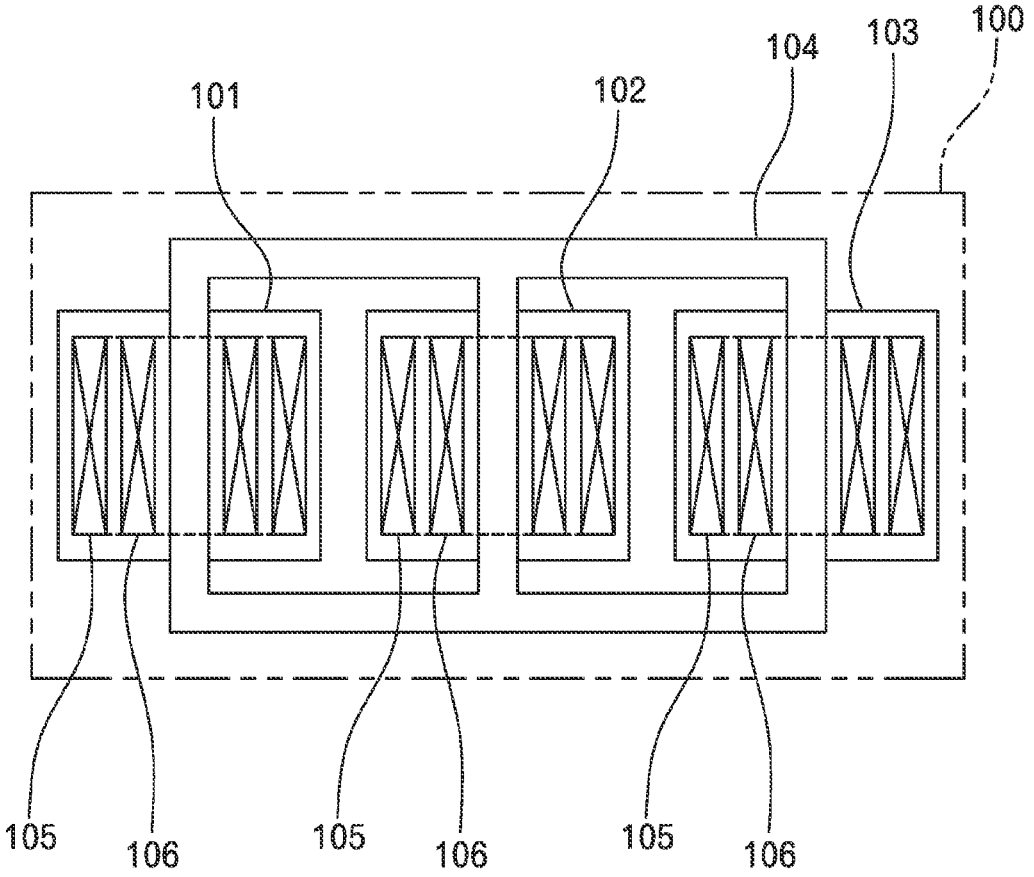
FIG. 13 is a diagram schematically illustrating a configuration of a transformer according to the present invention.

FIG. 13 illustrates a configuration of a transformer according to the present invention. Three coil assemblies 101, 102, 103 for three phases and a core 104 passing through the coil assemblies 101, 102, 103 to form a magnetic path are accommodated within a housing 100. Also, each of the three coil assemblies 101, 102, 103 coaxially includes primary windings 105 and secondary windings 106, and the coil 1 illustrated in FIG. 8 is adopted as the primary winding 105.

In such a transformer, since the number of turns of the primary winding 105 exceeds 300 times, a size of the transformer is determined by a size of the coil configuring the primary winding 105.

According to the transformer of the present invention, since the pluralities of unit wound portions 14, 15 are arrayed in close contact with each other in the coil 1 configuring the primary winding 105, miniaturization of the coil 1 and also miniaturization of the transformer can be realized. Moreover, since iron loss can be reduced by miniaturization of the core 104 accompanying the miniaturization of the coil 1, low loss of the transformer can be realized.

It should be noted that the respective configurations of the present invention are not limited to those in the above-described embodiment and that various modifications are possible within a technical scope described in the claims. For example, the rotation axis 23 of the winding machine 2 is not limited to be disposed horizontally and can be disposed vertically. In this case, the coil 1 is spirally wound around a vertical winding axis.

Further, reception of the pressing force by the guide plate 7 illustrated in FIG. 2 can be omitted depending on a material or a cross-sectional shape of the conductive wire. Also, guiding by the guide plate 7 is not always required in the forming process of the outward wound unit coil portion 14.

Further, the coil winding method of the present invention can obtain a particularly large effect in manufacturing the coil 1 formed of a rectangular wire having a rectangular cross-section. However, the present invention is not limited to this configuration. The method can be used in manufacturing a coil formed of various conductive wires, such as a circular wire or an elliptical wire.

It should be noted that in a case of the rectangular wire having a rectangular cross-section, the wire is not limited to have the laterally long rectangular cross-section and may have a longitudinally long rectangular cross-section.

Further, in the above-described embodiment, in the repetition of the outward wound unit coil portion forming process and the inward wound unit coil portion forming process, the method first starts from the outward wound unit coil portion forming process and ends in the outward wound unit coil portion forming process. However, the present invention is not limited to this. There can be employed a method which first starts from the outward wound unit coil portion forming process and ends in the inward wound unit coil portion forming process, a method which first starts from the inward wound unit coil portion forming process and ends in the inward wound unit coil portion forming process, or a method which first starts from the inward wound unit coil portion forming process and ends in the outward wound unit coil portion forming process.

For example, according to the method which first starts from the inward wound unit coil portion forming process and ends in the outward wound unit coil portion forming process, the winding start portion 12 and the winding end portion 13 serving as a pair of lead-out wires can be drawn out from the unit wound portion in the outermost circumference of the coil 1. Accordingly, it is not necessary to have a space which is needed in a case of drawing out the lead-out wire from the innermost circumference portion to outside, and therefore, the coil is miniaturized. Moreover, connection of the adjacent coil or the like with an outer circuit becomes easy.

It should be noted that the winding start portion 12 and the winding end portion 13 are not limited to the configuration in which they are drawn out from the unit wound portion in the outermost circumference or the unit wound portion in the innermost circumference of the unit coil portion having two ends, and the winding start portion 12 and the winding end portion 13 can be also drawn out from an intermediate unit wound portion.

Further, the transformer according to the present invention is not limited to the configuration in which the primary winding 105 is formed of the coil 1 of the present invention. The transformer can have a configuration in which the secondary winding 106 is formed of the coil 1 of the present invention, or in which each of the primary winding 105 and the secondary winding 106 is formed of the coil 1 of the present invention.

Furthermore, the transformer according to the present invention is not limited to the transformer for large power and high voltage. The present invention can be implemented to transformers for various uses including a transformer for small power and low and high voltage.

DESCRIPTION OF REFERENCE CHARACTERS

1 coil
14 outward wound unit coil portion
15 inward wound unit coil portion
16 connecting wire
2 winding machine
3 conductive wire winding portion
31 winding base member
4 conductive wire winding control mechanism
41 first winding member
42 second winding member
43 third winding member
44 fourth winding member
45 fifth winding member
46 sixth winding member
47 groove
51 support pin
6 reciprocally driving device
7 guide plate
105 primary winding
106 secondary winding
104 core While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

What is claimed is:

1. A coil winding method in a manufacturing method of a coil in which unit coil portions formed by spirally winding at least one conductive wire are repeatedly placed side by side in a winding axis direction, each of the unit coil portions is formed of a plurality of unit wound portions having mutually different inner circumferential lengths, and at least a part of the unit wound portion having a small inner circumferential length enters inside the unit wound portion having a large inner circumferential length, the coil winding method comprising:

an outward wound unit coil portion forming step of spirally winding the conductive wire from an inner circumferential side toward an outer circumferential side and forming an outward wound unit coil portion formed of the plurality of unit wound portions laminated along a surface orthogonal to a winding axis; and an inward wound unit coil portion forming step of spirally winding the conductive wire from the outer circumferential side toward the inner circumferential side and forming an inward wound unit coil portion formed of the plurality of unit wound portions laminated along the surface orthogonal to the winding axis, wherein by alternately repeating the outward wound unit coil portion forming step and the inward wound unit coil portion forming step, the outward wound unit coil portion and the inward wound unit coil portion are alternately placed along the winding axis, in the outward wound unit coil portion forming step, a step of forming the unit wound portion on an outer circumferential side by laminating on an outer circumferential surface of the unit wound portion on an inner circumferential side is repeated from the inner circumferential side toward the outer circumferential side, and in the inward wound unit coil portion forming step, a step of forming the unit wound portion at a position spaced apart from a forming position of the inward wound unit coil portion and pushing in the unit wound portion along the winding axis direction to the forming position of the inward wound unit coil portion is repeated from the outer circumferential side toward the inner circumferential side.

2. The winding method according to claim 1, wherein in the repetition of the outward wound unit coil portion forming step and the inward wound unit coil portion forming step, the method first starts from the outward wound unit coil portion forming step and ends in the inward wound unit coil portion forming step.

3. The winding method according to claim 1, wherein in the repetition of the outward wound unit coil portion forming step and the inward wound unit coil portion forming step, the method first starts from the outward wound unit coil portion forming step and ends in the outward wound unit coil portion forming step.

4. The winding method according to claim 1, wherein in the repetition of the outward wound unit coil portion forming step and the inward wound unit coil portion forming step, the method first starts from the inward wound unit coil portion forming step and ends in the inward wound unit coil portion forming step.

5. The winding method according to claim 1, wherein in the repetition of the outward wound unit coil portion forming step and the inward wound unit coil portion forming step, the method first starts from the inward wound unit coil portion forming step and ends in the outward wound unit coil portion forming step.

6. A coil winding method in a manufacturing method of a coil in which unit coil portions formed by spirally winding at least one conductive wire are repeatedly placed side by side in a winding axis direction, each of the unit coil portions is formed of a plurality of unit wound portions having mutually different inner circumferential lengths, and at least a part of the unit wound portion having a small inner circumferential length enters inside the unit wound portion having a large inner circumferential length, the coil winding method comprising:

an outward wound unit coil portion forming step of spirally winding the conductive wire from an inner circumferential side toward an outer circumferential side and forming an outward wound unit coil portion formed of the plurality of unit wound portions laminated along a surface orthogonal to a winding axis; and an inward wound unit coil portion forming step of spirally winding the conductive wire from the outer circumferential side toward the inner circumferential side and forming an inward wound unit coil portion formed of the plurality of unit wound portions laminated along the surface orthogonal to the winding axis, wherein by alternately repeating the outward wound unit coil portion forming step and the inward wound unit coil portion forming step, the outward wound unit coil portion and the inward wound unit coil portion are alternately placed along the winding axis, in the outward wound unit coil portion forming step, a step of forming the unit wound portion on an outer circumferential side by laminating on an outer circumferential surface of the unit wound portion on an inner circumferential side is repeated from the inner circumferential side toward the outer circumferential side, and in the inward wound unit coil portion forming step, a step of forming the unit wound portion at a position spaced apart from a side surface of the outward wound unit coil portion formed immediately before and pushing in the unit wound portion along the winding axis direction until the unit wound portion makes contact with the side surface of the outward wound unit coil portion is repeated from the outer circumferential side toward the inner circumferential side.

7. The winding method according to claim 6, wherein in the inward wound unit coil portion forming step, after the unit wound portion in an outermost circumference which is in contact with the side surface of the outward wound unit coil portion formed immediately before is formed, a step of forming the unit wound portion at a position spaced apart from the side surface of the outward wound unit coil portion by at least a width dimension of the conductive wire and pushing in the unit wound portion along the winding axis direction until the unit wound portion makes contact with the side surface of the outward wound unit coil portion is repeated from the outer circumferential side toward the inner circumferential side.

8. The winding method according to claim 1, wherein in the outward wound unit coil portion forming step, by rotating a winding base member around the winding axis, plural layers of the unit wound portions are laminated around the winding base member.

9. The winding method according to claim 1, wherein in the inward wound unit coil portion forming step, the plurality of unit wound portions is formed by rotating a conductive wire winding control mechanism around the winding axis, the conductive wire winding control mechanism includes a plurality of winding members laminated in a direction orthogonal to the winding axis and a reciprocally driving device causing each of the winding members to reciprocate along the winding axis, and due to operation of the reciprocally driving device, by rotating the conductive wire winding control mechanism in a state in which an outer circumferential surface of one winding member of the plurality of winding members is exposed, the conductive wire is wound around the outer circumferential surface of the one winding member, and the unit wound portion having an inner circumferential length according to an outer shape of the one winding member is formed.

10. The winding method according to claim 9, wherein in the inward wound unit coil portion forming step, after the one unit wound portion is formed by winding the conductive wire around the outer circumferential surface of the one winding member, by advancing the winding member disposed on an outer circumferential side of the one winding member in the winding axis direction, the unit wound portion is pushed in until the unit wound portion makes contact with the side surface of the outward wound unit coil portion.

11. The winding method according to claim 10, wherein after the unit wound portion is pushed in due to the advance of the winding member, the winding member disposed on an inner circumferential side of the winding member is caused to retreat together with one or the plurality of winding members disposed further on the outer circumferential side than the winding member on the inner circumferential side, so that an outer circumferential surface of the winding member on the inner circumferential side, around which the conductive wire is to be wound next, is exposed.

12. The winding method according to claim 11, wherein the conductive wire winding control mechanism is provided with a support member which supports, even after the retreat of the winding member, the unit wound portion pushed in until the unit wound portion makes contact with the side surface of the outward wound unit coil portion.

13. The winding method according to claim 9, wherein after the outward wound unit coil portion or the inward wound unit coil portion is formed, by advancing all the winding members of the conductive wire winding control mechanism, all the previously formed unit coil portions are moved in the winding axis direction by the width dimension of the conductive wire.

14. The winding method according to claim 9, wherein in the step of pushing in the unit wound portion due to the advance of the winding member, by abutting a guide plate on the side surface of the first formed outward wound unit coil portion, pressing force due to the advance of the winding member is received.

15. The winding method according to claim 1, wherein when the inward wound unit coil portion is formed after the formation of the outward wound unit coil portion, a connecting wire provided from the unit wound portion in the outermost circumference of the outward wound unit coil portion to the unit wound portion in the outermost circumference of the inward wound unit coil portion is formed at the conductive wire, and when the outward wound unit coil portion is formed after the formation of the inward wound unit coil portion, a connecting wire provided from the unit wound portion in an innermost circumference of the inward wound unit coil portion to the unit wound portion in an innermost circumference of the outward wound unit coil portion is formed at the conductive wire.

16. The winding method according to claim 15, wherein the connecting wire is formed by bending the conductive wire into an S shape between the adjacent unit coil portions.

17. A transformer including a primary winding and a secondary winding, comprising:

a coil configuring any one or both of the primary winding and the secondary winding, including:

an outward wound unit coil portion formed of a plurality of unit wound portions which is formed by spirally winding a conductive wire from an inner circumferential side toward an outer circumferential side and is laminated along a surface orthogonal to a winding axis; and an inward wound unit coil portion formed of a plurality of unit wound portions which is formed by spirally winding the conductive wire from the outer circumferential side to the inner circumferential side and is laminated along the surface orthogonal to the winding axis, wherein the outward wound unit coil portion and the inward wound unit coil portion are alternately placed along the winding axis, in the outward wound unit coil portion and the inward wound unit coil portion which are adjacent to each other, the unit wound portions in the outermost circumference or the unit wound portions in the innermost circumference are connected with each other, and a connecting wire which connects the unit wound portions in the outermost circumference with each other or the unit wound portions in the innermost circumference with each other is bent into an S shape between the adjacent unit coil portions.

* * * * *